US006036386A

United States Patent [19]

McDonald

[11] Patent Number: 6,036,386

[45] Date of Patent: Mar. 14, 2000

[54] PORTABLE GOLF BALL WASHER

[76] Inventor: Gayle McDonald, 151 W. 5275, South Murray, Utah 84107

[21] Appl. No.: 09/080,564

[22] Filed: May 18, 1998

[51] Int. Cl.[7] ..... A63B 47/04; A63B 57/00

[52] U.S. Cl. ..... 401/10; 401/11; 15/21.2

[58] Field of Search ..... 401/9, 10, 11; 15/21.2, 104.92

[56] References Cited

U.S. PATENT DOCUMENTS

| | | | |
|---|---|---|---|
| 1,565,414 | 12/1925 | Byrne | 401/9 X |
| 3,087,189 | 4/1963 | Scanlon | 401/11 |
| 3,098,252 | 7/1963 | Sundquist | 15/104.92 X |
| 3,758,912 | 9/1973 | Shibuya et al. | 401/10 X |
| 5,339,486 | 8/1994 | Persic, Jr. | 15/21.2 X |

FOREIGN PATENT DOCUMENTS

| | | | |
|---|---|---|---|
| 3118196 | 12/1982 | Germany | 401/10 |

*Primary Examiner*—Steven A. Bratlie

*Attorney, Agent, or Firm*—M. Reid Russell

[57] ABSTRACT

The invention is in a portable golf ball washer arranged to be maintained to a golfer's person, or to their golf bag or cart, and is useful for washing the surface of a golf ball during a round of golf The washer includes a pair of sections, that are preferably each a half sphere having a center open area therein to receive a half spherical washer pad fitted therein that itself includes a center half spherical opening formed to fit to the golf ball surface. The half spherical sections are connected to turn, one with the other, whereby the washer pads move back and forth over the surface of a contained golf ball, remove dirt and scruff marks therefrom. To facilitate which half spherical segment turning, in one embodiment a half a handle is mounted to one of the segments to be turnable by the golfer who holds the other segment in place, with both the embodiments of the invention each including a washer solution reservoir for dispensing a washer solution into the coupled half spherical sections, wetting the washer pads therein so as to increase golf ball washing efficiency.

6 Claims, 4 Drawing Sheets

PORTABLE GOLF BALL WASHER

BACKGROUND OF THE INVENTION

1. Field of the Invention

This invention relates to golf ball washing device and in particular to portable golf ball washers to be conveniently carried on a golfer's person during play or attached to their golf club bag, cart, or the like.

2. Prior Art

Golf ball washers or cleaners are, of course, well known and a number of such ball washer devices for carrying by, or capable of being carried by a golfer, as by attachment to their person, golf bag, golf cart, golf cart handle, or the like, have been developed. For example, a golf ball cleaner is shown in an early U.S. Pat. No. 1,639,740 that provides for moving a first set of brushes relative to a second set of brushes to clean a ball that has been positioned therebetween, with a brush arrangement shown also in an earlier British Patent No. 12,853. These arrangements, however, are not like the present invention that does not employ opposing brushes. Golf ball cleaning arrangements that incorporate a casing containing spongy pads, with the spongy pads receiving a golf ball fitted between cleaning surfaces thereof, and the springy pads to be moved relative to one another, are shown in U.S. Pat. No. to Smith, U.S. Pat. No. 3,041,645; to Strout, U.S. Pat. No. 3,378,873; to MacConnel, U.S. Pat. No. 3,750,219; and to Ingram, et al. U.S. Pat. No. 4,084,287. These patents, however, do not employ separate cup sections that each contain a cleaning material and are arranged to receive and clamp over a golf ball fitted therebetween, with the cup sections containing cleaning pads to be manually movable relative to one another, moving also the cleaning material across the golf ball surface, that is like the arrangement of the present invention.

Opposing cup arrangements, each containing a pad, or pad like cleaning surface, with the cups openable to receive a golf ball fitted therein, with the cups capable of being closed together, and providing for movement of the cleaning pads, or pad like cleaning surfaces over the golf ball surface, removing materials therefrom, are shown in U.S. Pat. No. to Hoffecker, U.S. Pat. No. 3,006,009; to Sharrow, et al., U.S. Pat. No. 4,422,040; and to Persic, Jr., U.S. Pat. No. 5,339,486, and in British Patents to Epstein, No. 6,260; to Harrison, et al. No. 213,428; and to Winstanley, et al. No. 21,120,948. These arrangements, similar to the present invention including half spherical, cup, or like members, that are to be fitted or closed together over a golf ball, and provide for moving one member relative to the other to move also cleaning materials or pads over the golf ball surface, with the cups then openable to allow retrieval of the cleaned golf ball. These earlier arrangements, however, to do include a restorable reservoir system that is to contain a cleaning solution and feed measured amounts of that cleaning solution into the cleaning pads, for facilitating removal of materials off from the golf ball surface, as do the embodiments of the present invention. Nor do such earlier cleaners employ a handle arrangement that is like that provided in one embodiment of the present invention

SUMMARY OF THE INVENTION

It is a principal object of the present invention to provide a portable golf ball cleaner that is capable of being conveniently carried by a golfer on their person or attached to their golf bag or cart, that is for receiving a golf ball fitted therein and includes manually moveable elements contained in the cleaner to move over to clean the golf ball surface, removing dirt, scuffs, and the like, therefrom.

Anther object of the present invention is to provide a portable golf ball cleaner that includes a pair of cup or half spherical sections that are arranged to be coupled together and allow one cup to be turned relative to the other, with the individual cups each including a lining of a cleaning material, such as a foam pad, that is secured to the cup interior wall such that, with the joined cups closed over a golf ball, and when the cups are turned relative to one another, the cleaning material will scrub the golf ball surface, cleaning dirt, scuffs, and the like, therefrom.

Another object of the present invention is to provide, with the portable ball cleaner, a reservoir and fill arrangement with one of the cups that is to receive and maintain a cleaning solution that is passed into the cup interior, to flow outwardly into the cleaning material that contacts the golf ball surface.

Still another object of the present invention is to provide, in one embodiment, a handle extending outwardly from one of the cups for gripping by an operator who holds the other cup in their other hand, with the handle used to turn the one cup relative to the other, and which handle also provides a point of attachment for a chain, or the like, for use in maintaining the invention onto a golfers belt, to the golf bag, cart, or the like.

Still another object of the present invention is to provide a golf ball cleaning devide that is portable to be convenient for use by a golfer holding and operating the cleaning device to clean a golf ball before teeing up that ball.

The invention is in a portable golf ball cleaner that is arranged to be conveniently carried or attached to a golfer's person as by passing a light chain attached to the cleaner through the golfer's belt loop, to a golf club bag, around a golf cart handle, or the like, with the cleaner for use in cleaning a golf ball before that ball is teed up and driven. The cleaner of the invention employs open half spherical members or cups that are to be fitted together to have an open spherical center wherein washer pads are arranged, with each washer pad including an open center area to snugly fit over and engage a golf ball surface. The half spherical members or cups are arranged to turn along their junctions to move back and forth relative to one another. In such back and forth movement of the one spherical section over the other, the half spherical washer pad lining of each of the spherical sections will travel over the contained golf ball surface, scrubbing that ball surface so as to remove materials therefrom.

To improve the efficiency of the ball washing process, the invention further includes a reservoir for filling with a washer solution to provide a drip feeding of that solution into the washer center cavity, wetting the washer pads. The reservoir, in one embodiment, is included as part of a hollow handle shaft whose upper end is crossed by a hand engaging portion that is for gripping by an operator to turn the one spherical section or cup relative to the other and includes a cap to close over the handle top end, containing the washer solution in the reservoir with, in another embodiment of the invention, the reservoir is a short cylinder included in the top of the spherical member that is open into the spherical member interior to drip feed washer solution through a port into the washer center cavity and is closed over by a cap.

BRIEF DESCRIPTION OF THE DRAWINGS

These and other object of the present invention will become more fully apparent from the following description in which the invention is describe in detail in conjunction with the accompanying drawings.

DETAILED DESCRIPTION OF THE INVENTION

Figure 1:
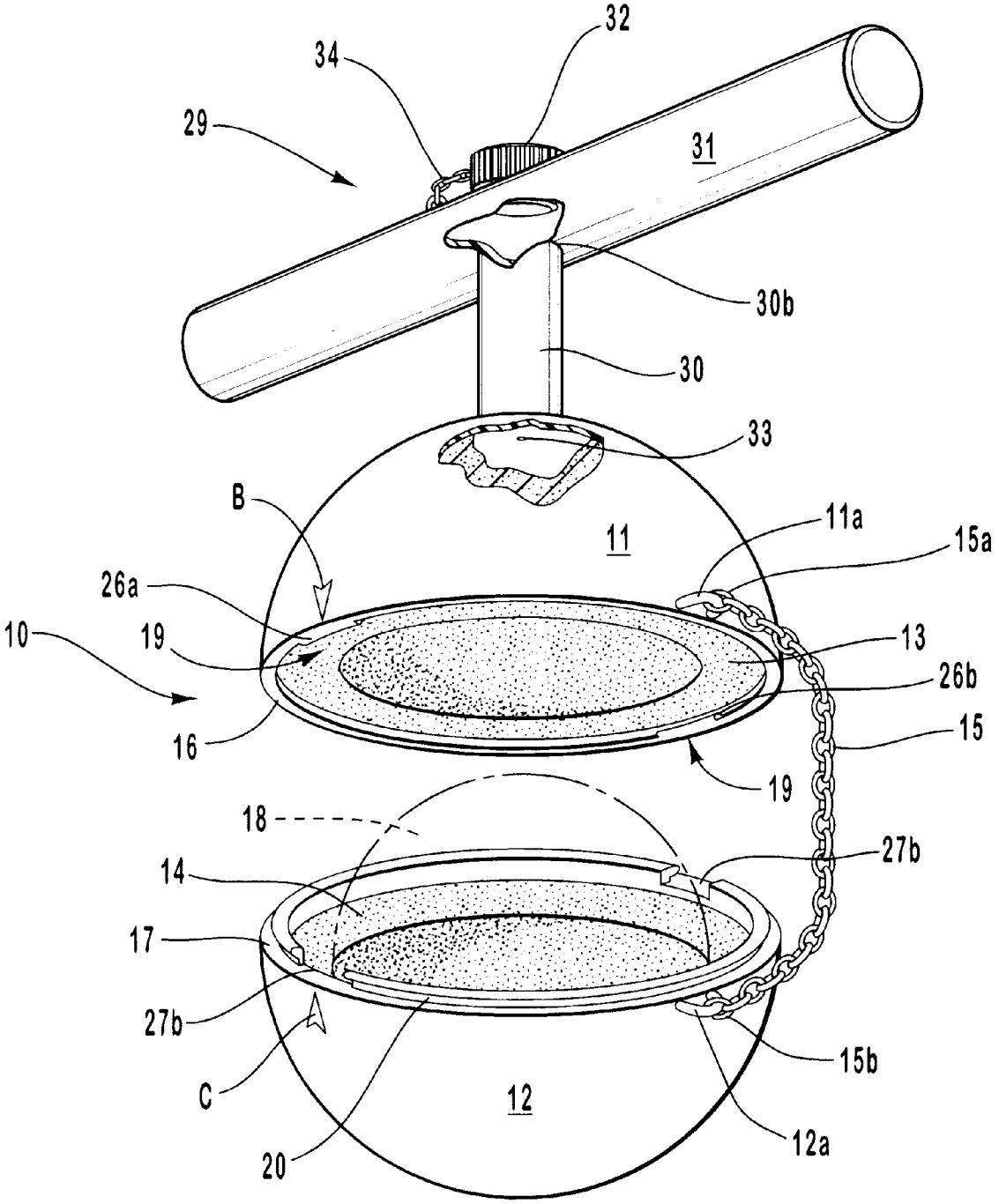
FIG. 1 is a Front elevation perspective view of a first embodiment of a portable ball cleaner of the invention showing the cleaner as including a pair of half spherical sections or cups tethered together by a light chain, with a pair of lugs shown projecting inwardly from the edge of the top section that are each aligned to fit into a groove that is formed in a track formed in the bottom section edge, and includes a handle shown extending outwardly from a top of the half spherical sections that has broken away sections opening into the handle stem that functions also as a reservoir.
Figure 3:
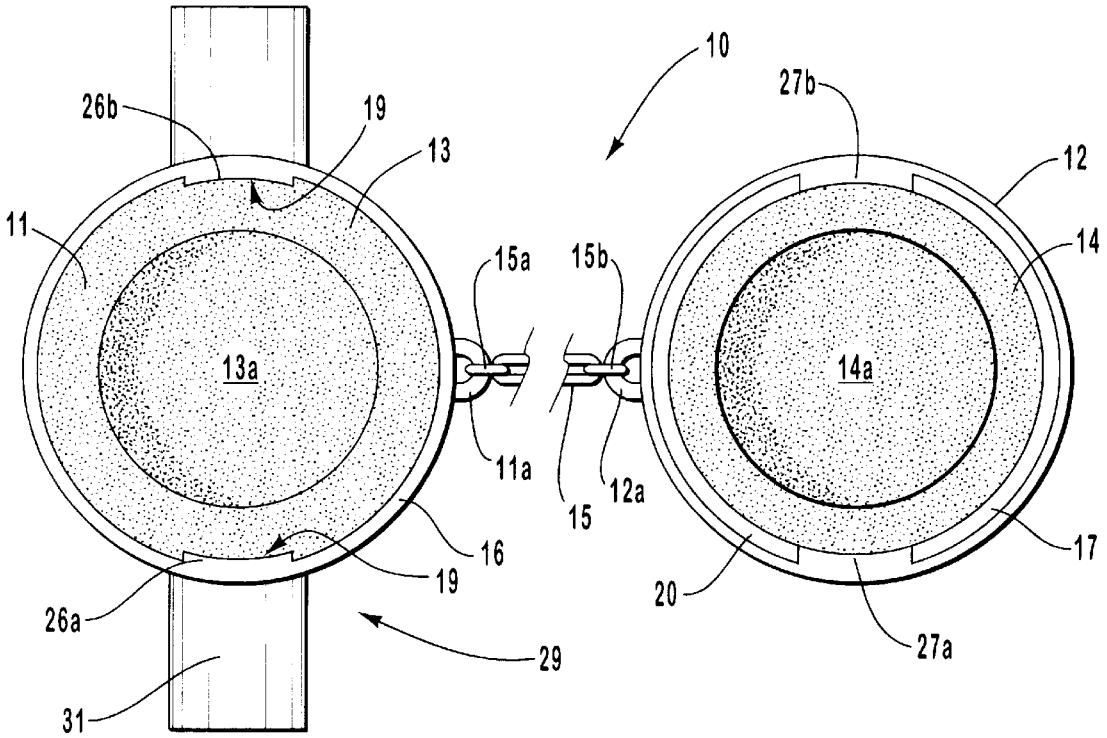
FIG. 3 is a bottom plan view of the top and bottom half spherical sections or cups that have been opened and showing a washer pad fitted in each, lining the half sphere interior.
Figure 4:
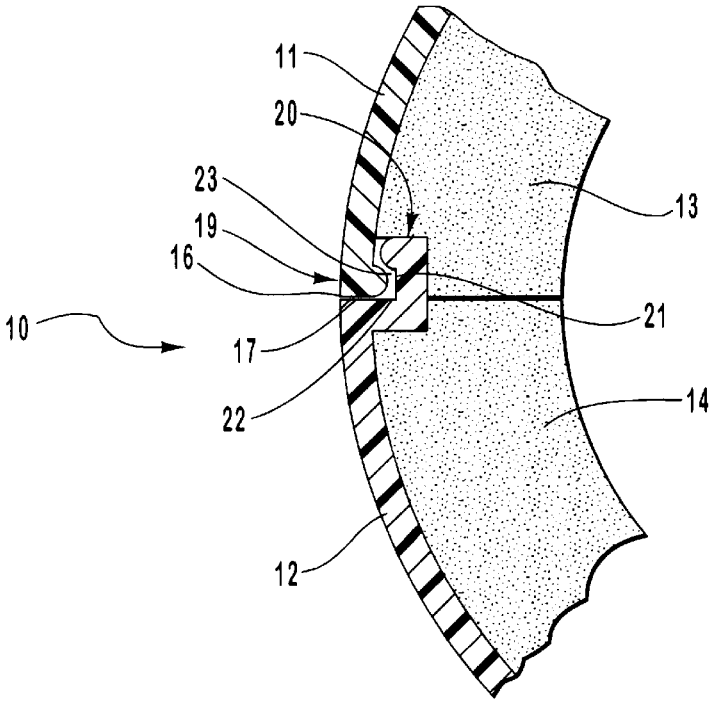
FIG. 4 is a sectional view taken along the line 4—4 of FIG. 2, showing lugs of the top half spherical section or cup fitted to a track of the bottom half spherical section or cup, for maintaining the sections or cups together as at least one section or cup is turned back and forth relative to the other.

Referring now to the drawings:

FIG. 1 shows a first embodiment of a portable golf ball cleaner 10 of the invention as a front elevation perspective view to include top and bottom half spherical sections or cups 11 and 12, respectively, that are each shown as being uniform thin wall half spheres each having open interiors and are each fitted with a half spherical section of a washer pad 13 and 14, respectively, as shown also in FIGS. 3 and 4, that each have a half spherical center cavity 13*a* and 14*a*, as shown in FIG. 3. Coupling links 11*a* and 12*a* are secured to extend outwardly from the sides of the sections or cups 11 and 12, respectively, proximate to edges 16 and 17 thereof, that are for connection to ends 11*a* and 15*b*, respectively, of a light chain 15. Shown in FIG. 3, the washer pads are each formed to have center half spherical cavities, 13*a* and 14*a*, respectively, and are preferably formed from sections of soft flexible material, such as a sponge type material that will hold and accommodate a flow therethrough. The respective half spherical cavities 13*a* and 14*a* are to receive a golf ball 18 fitted therein, shown as a broken line sphere in FIG. 1.

Figure 2:
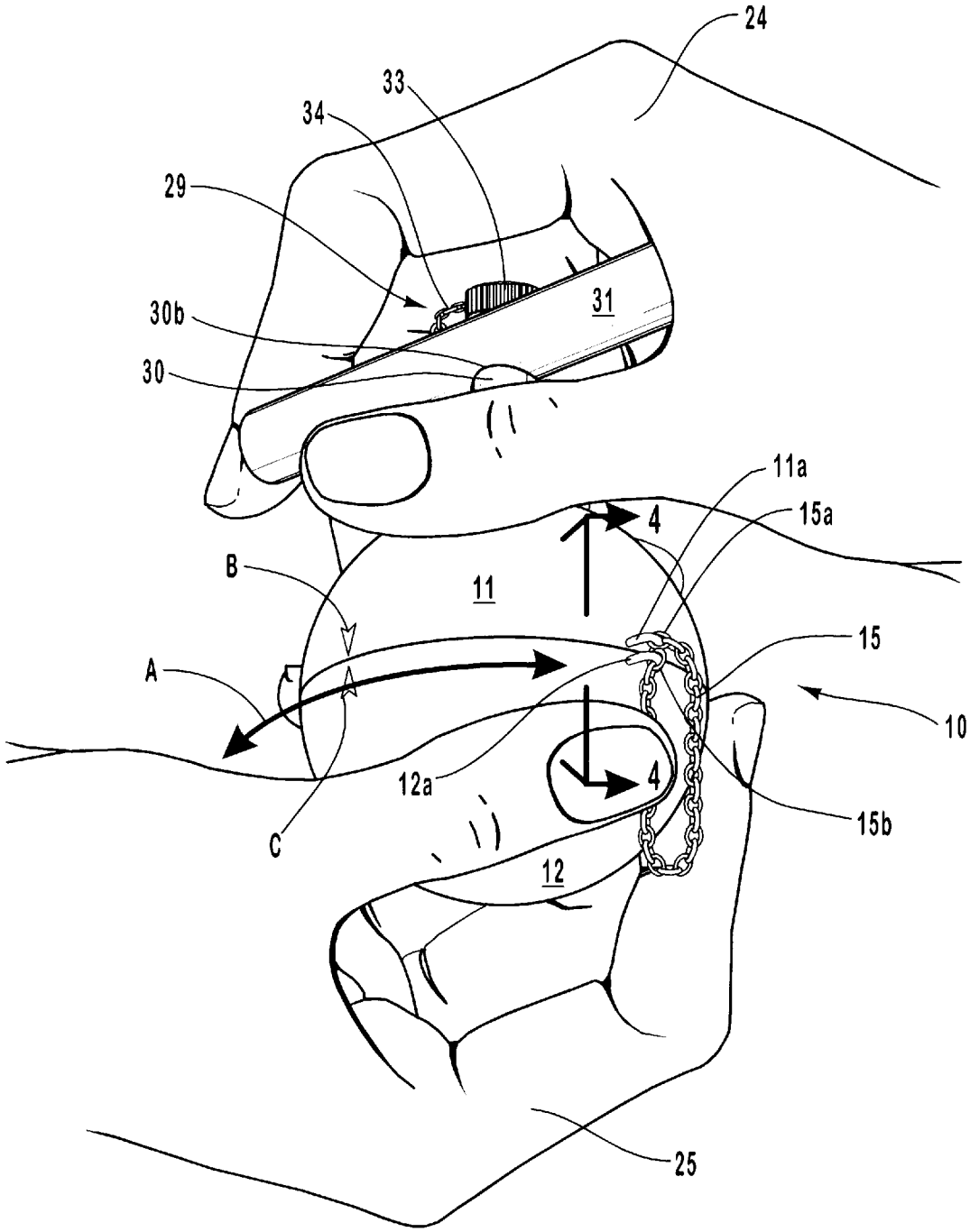
FIG. 2 is a view like that of FIG. 1 showing the half spherical sections or cups joined together with a lower section held in an operator's hand and with the operator's other band holding the handle that is used to turn the one half spherical section back and forth relative to the other, illustrated by arrow A.

Shown in FIGS. 1 and 4, the half spherical sections are fitted together so as to allow the respective top and bottom sections or cups 11 and 12, to be moved back and forth as illustrated at arrow A in FIG. 2. Shown best in FIG. 4 to provide this coupling the top half spherical section includes top male track sections 19 with the bottom spherical section employing a female track 20, that each are formed to extend from the half spherical edges 16 and 17, respectively. The track sections 19 extending inwardly with the female track 20 extending at a right angle upwardly from the respective edges 16 and 17. The top male track sections 19, as shown best in FIG. 4, are formed shown as lugs 26*a* and 26*b* having rounded section ends that each extend inwardly from the edge 16, and are adjacent thereto. The bottom female track 20 has a rounded outer end and projects upwardly from an outer end of a leg 20 of right angle member that includes legs 21 and 22, which leg 22 is connected, also at a right angle, to project inwardly from the half spherical edge 17. Each top male track 19 section, as shown in FIG. 4, is fitted to travel in a saddle formed in the bottom female track 20, between the rounded end and leg 22, such that the bottom female track 20 rounded end will travel alongside the male track sections rounded ends. So arranged, the top male track sections 19 and bottom female track 20 maintain the half spherical sections 11 and 12 together, allowing them to be turned relative to one another, as illustrated by double arrow A in FIG. 2. With the chain 15, as shown in FIGS. 1, 2 and 3, to limit turning of the respective half spherical sections 11 and 12 relative to one another.

FIG. 1 shows a preferred arrangement for fitting the respective half spherical sections 11 and 12 together, allowing them to be turned, as illustrated in FIG. 2, and showing the respective half spherical sections 11 and 12 maintained in an operators hands 24 and 25. The coupling arrangement, shown in FIGS. 1 and 3 as set out above, includes the pair of male track sections lugs 26*a* and 26*b* that extend at right angles inwardly from the edge 16 and are equidistant from one another, and are to fit through slots 27*a* and 27*b*, respectively, that are formed through the bottom female track 20, at equidistant intervals from one another. So arranged, the respective lugs 26*a* and 26*b* are aligned with the slots 27*a* and 27*b* by aligning arrows B and C, respectively, that are scribed onto the outer surfaces of the top and bottom half spherical sections 11 and 12, proximate to the edges 16 and 17 thereof, as shown in FIGS. 1 and 2. So aligned, an operator, shown as hands 24 and 25 in FIG. 2, fits the half spherical sections together and turns them relative to one another, illustrated by arrow A. This back and forth turning action causes the spherical surfaces 13*a* and 14*a* of the washer pads 13 and 14, respectively to slide over a golf ball 15 contained therebetween, scrubbing materials off from and cleaning the golf ball surface.

Shown in FIGS. 1 through 3, to facilitate turning the top half spherical section or cup 11 relative to the bottom half spherical section or cup 12, a handle 29 is secured at a lower end 30*a* of a handle stem 30 to extend outwardly from the center of the top half spherical section 11. The handle stem 30 is crossed at its top end 30*b* by a straight cross member 31, shown as a straight rod. The handle 29 stem 30, as illustrated in the broken away portions of FIG. 1, is preferably hollow to contain a ball washing solution. In operation, a washer solution is poured into the hollow stem through a top end thereof that is arranged to be closed over with a cap 32, and the solution is dispensed through a hole or port 33 that is formed through the top half spherical section top. The solution is dispersed through the respective pads 13 and 14 to contact and remove dirt and scuffs off from a golf ball 18 surface when the ball cleaner 10 is used, as described above. Preferably, to maintain the cap 32 to the handle 29, a chain 34 is attached at its ends to the cap 32 and handle cross member 31, as shown in FIG. 1.

Figure 5:
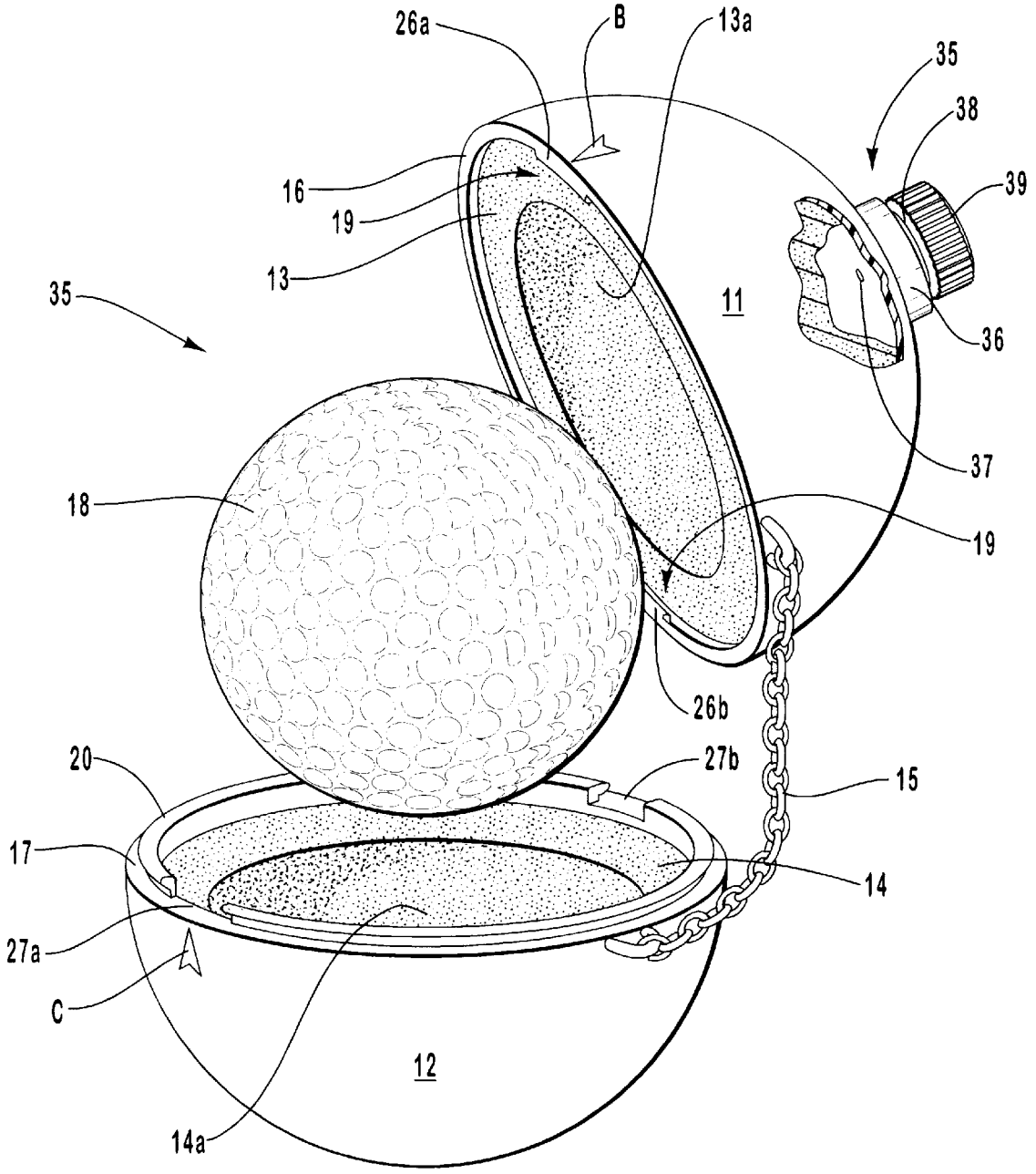
FIG. 5 is a front elevation perspective view of another embodiment of the portable ball cleaner of the invention that is like that of FIG. 1 except that the handle of the cleaner of FIG. 1 has been replaced with a short cylinder that is shown as being hollow and includes a cap fitted over a top end and showing a golf ball being fitted into the center cavity of the respective top and bottom half spherical sections or cups.

A second embodiment of a portable golf ball washer 35 of the invention is shown in FIG. 5 that is like the golf ball washer 10, as described above, and accordingly, as appropriate, component numbers of the washer 10 are also used to identify the like components of washer 35 except that the handle 29 of washer 10 is not included with the golf ball washer 35. Rather, as shown in FIG. 5, a washer solution reservoir, shown as a short tube 36, is secured to the center of the top of the top half spherical section 11 that includes a small opening or port 37 formed through the top half spherical section 11 that opens into the interior the top half spherical section 11 that, like the hole or port 33, is for dispensing washer solution from the tube 36 into the washer 35 interior. The dispensed solution to wet the washer pads 13 and 14 contained therein, facilitating cleaning the surface of golf ball 18, as shown. Like the top of the hollow stem 30 top end, a top end 38 of the short tube 36 is preferably closed by turning of a cap 39 thereover.

The two embodiments of the portable golf ball washers 10 and 35 as set out and described above are each for carrying on a golfer's person or are attached, as with chain 15, to a golf bag, golf cart, or the like. While the two embodiments of the portable golf ball washers 10 and 35 of the invention as shown and described herein are preferred, it should be understood that the present disclosure is made by way of example only and that variations to each of the embodiments and their use are possible within the scope of this disclosure without departing from the sjubject matter coming within the scope of the following claims and a reasonable equivalence thereof, which claims I reard as my invention.

I claim:

1. A portable golf ball washer comprising, a pair of top and bottom half spherical sections each having an open inner area; a pair of half spherical washer pad means each arranged for fitting in one of said top and bottom half spherical sections open inner areas, with each said half spherical washer pad means having a center half spherical cavity to fit tightly around a golf ball positioned between said half spherical washer pad means when said top and bottom half spherical sections are closed together; means for releasably coupling said top and bottom half spherical sections together along edges thereof so as to allow said top and bottom half spherical sections to be turned relative to one another comprising a female track that includes a leg connected on one end to extend inwardly from an edge of said bottom half spherical section that is bent at a right angle at its mid section to be parallel to said edge and connects at its other end to an outwardly directed rounded portion, and said top half spherical section includes at least a pair of male track sections that are spaced equidistantly from one another with each including a rounded end that extends inwardly from an edge of said top half spherical section, with each said male track section is to fit through a slot formed in said bottom half spherical section female track and couple therewith; reservoir means for containing a washer solution; and port means for passing a flow of said washer solution from said reservoir means into the coupled top and bottom half spherical sections so as to wet said half spherical washer pad means.

2. A portable golf ball washer as recited in claim 1, further including a chain connected at its ends to links that are each maintained to each of the top and bottom half spherical sections.

3. A portable golf ball washer as recited in claim 1, wherein the half spherical washer pad means are each formed from a soft sponge like water absorbing material that each have a half spherical shaped center cavity that, to receive the top and bottom half spherical sections fitted thereover, forming an open area therebetween to fit closely to a golf ball.

4. A portable golf ball washer as recited in claim 1, wherein the reservoir means is a handle that is secured, to extend outwardly from the center of an outer surface of either of the top or bottom half spherical sections, which said handle includes a hollow stem that is connected on a lower end thereof to said half spherical section surface and includes a cross member secured thereabove; cap means arranged for closing over a top end of said hollow stem; and the port means a narrow opening formed through said half spherical section surface within said hollow stem lower end.

5. A portable golf ball washer as recited in claim 4, wherein the cap means is a cap having interior threads for turning onto a threaded end of the hollow stem; and a chain is connected at its ends to a top surface of said cap and to the handle cross member.

6. A portable golf ball washer as recited in claim 1, wherein the reservoir means is a short hollow sleeve secured to extend outward from the center of an outer surface of either of the top or bottom half spherical sections, above the port means formed through said half spherical section surface; and means for closing said short hollow sleeve.

* * * * *